US007570154B2

(12) United States Patent
Bartorelli et al.

(10) Patent No.: US 7,570,154 B2
(45) Date of Patent: Aug. 4, 2009

(54) WIRELESS DOOR CHIME HAVING CHANGEABLE HIGH QUALITY SOUNDS AND METHOD THEREFOR

(75) Inventors: Joseph M. Bartorelli, Scottsdale, AZ (US); Kevin J. Wall, Tempe, AZ (US)

(73) Assignee: O-Zone Management Corporation, Scottsdale, AZ (US)

( * ) Notice: Subject to any disclaimer, the term of this patent is extended or adjusted under 35 U.S.C. 154(b) by 57 days.

(21) Appl. No.: 11/211,822

(22) Filed: Aug. 25, 2005

(65) Prior Publication Data

US 2007/0046442 A1 Mar. 1, 2007

(51) Int. Cl.
*G08B 3/00* (2006.01)

(52) U.S. Cl. ..... 340/384.1; 340/328; 340/384.5; 340/392.1; 340/539.1

(58) Field of Classification Search ..... 340/384.1, 340/384.5, 328, 392.1, 392.5, 539.1, 691.1, 340/393.3

See application file for complete search history.

(56) References Cited

U.S. PATENT DOCUMENTS

| | | | | |
|---|---|---|---|---|
| 5,365,214 | A * | 11/1994 | Angott et al. | 340/328 |
| 5,657,380 | A * | 8/1997 | Mozer | 379/88.01 |
| 6,175,298 | B1 * | 1/2001 | Xydis | 340/392.1 |
| 6,545,595 | B1 * | 4/2003 | Xydis | 340/392.1 |
| 6,759,955 | B2 * | 7/2004 | Koneff et al. | 340/539.1 |
| 7,023,327 | B1 * | 4/2006 | Chen | 340/392.5 |
| 7,079,014 | B2 * | 7/2006 | Steinetz et al. | 340/392.1 |

* cited by examiner

*Primary Examiner*—Davetta W Goins
(74) *Attorney, Agent, or Firm*—Jeffrey D. Moy; Weiss & Moy, P.C.

(57) ABSTRACT

A wireless door chime system has an activation unit. A receiving unit is in wireless communication with the activation unit. The receiving unit has a plurality of sound files loaded therein. A user can view the plurality of sound files and select a sound file to play when the activation unit sends a signal to the receiving unit.

11 Claims, 2 Drawing Sheets

WIRELESS DOOR CHIME HAVING CHANGEABLE HIGH QUALITY SOUNDS AND METHOD THEREFOR

BACKGROUND OF THE INVENTION

1. Field of the Invention

This invention relates generally to door chimes and, more particularly, to a wireless door chime that uses high quality recorded sounds to indicate activation of the door chime. The wireless door chime has a removable storage device to allow one to easily change the recorded sounds to be played during activation of the door chime.

2. Description of the Prior Art

Wireless door chimes are known in the art. U.S. Pat. No. 5,365,214, discloses a door chime having multiple detectors which transmit radio frequency ("RF") signals to a common receiver upon the depression of doorbell buttons. Each detectors is associated with a specific doorbell button and includes means for allowing manual selection of a song or melody to be played by the receiver upon the receiver's receipt of the RF signal from the detector. The system allows different audible indications to be played in response to the depression of the doorbell button associated with a particular detector. As a result, a user can program each detector, such as a front doorbell detector and a back door detector, to signal, through its RF signal, the receiver to play a distinct audible indication whenever a specific doorbell button is pressed so that a user can determine from the audible indication played by the receiver which doorbell button was pressed.

U.S. Pat. No. 5,545,595 discloses a door chime system that is capable of storing and playing a CD quality sound that has been recorded. The door chime system includes a door chime detector which sends a signals whenever it detects the activation of a doorbell button. A receiver receives the signal from the door chime detector. The receiver has circuitry which outputs data sent from the door chime detector. A code detector has an input which receives data output from the receiver. The code detector determines whether a door chime sound is to be played as a result of receiving the signal from the door chime detector and provides a command to play the high quality sound. A sound memory is proved and has an input which receives a command from the code detector and outputs a signal representing a high quality sound upon receipt of the command. A sound producing means converts the high quality sound signals from the sound memory into an audible sound.

A particular problem with the above systems is that the door chimes only play one sound. In order to change the sound, one has to either reprogram the door chime or load a new and different sound into the door chime. This may be time consuming or problematic to many people who may not be very technically savvy. Furthermore, none of the above systems allow one to see what sound is currently loaded in the door chime. Thus, even if one changes the sound to be played by the door chime, those unfamiliar with the change will not know what sound is currently loaded.

Therefore, a need existed to provide an improved wireless door chime system that overcomes the above problems associated with prior art door chimes. The improved wireless door chime system must be able to store and play a plurality of different high quality sounds. The improved wireless door chime system must be able to easily change and store different groups of high quality sounds. The improved wireless door chime system must also be able to allow one to see the current sound which is being played by the door chime.

SUMMARY OF THE INVENTION

In accordance with one embodiment of the present invention, it is an object of the present invention to provide an improved wireless door chime system that overcomes the above problems associated with prior art door chimes.

It is another object of the present invention to provide an improved wireless-door chime system that is able to store and play a plurality of different high quality sounds.

It is yet another object of the present invention to provide an improved wireless door chime system that is able to easily change and store different groups of high quality sounds.

It is still another object of the present invention to provide an improved wireless door chime system that allows one to see the current sound which is being played by the door chime.

BRIEF DESCRIPTION OF THE EMBODIMENTS

In accordance with one embodiment of the present invention, a wireless door chime system is disclosed. The wireless door chime system has an activation unit. A receiving unit is in wireless communication with the activation unit. The receiving unit has a plurality of sound files loaded therein. A user can view the plurality of sound files and select a sound file to play when the activation unit sends a signal to the receiving unit.

In accordance with another embodiment of the present invention, a wireless door chime system is disclosed. The wireless door chime system has an activation unit. The activation unit has a transmitting antenna. A transmitter is coupled to the transmitting antenna. An encoder is coupled to the transmitter. An activation switch is coupled to the encoder. A receiving unit is in wireless communication with the activation unit. The receiving unit has a plurality of sound files loaded therein. A user can view the plurality of sound files and select a sound file to play when the activation unit sends a signal to the receiving unit. The receiving unit has a receiving antenna. A receiving unit is coupled to the receiving antenna. A processing unit is coupled to the receiving unit. The processing unit stores at least one sound file. A decoding unit is coupled to the processing unit for decoding a sound file to be played. A speaker is coupled to the decoding unit. A memory storage reader is coupled to the processing unit. The memory storage reader transfers sound files stored on a memory storage device to the processing unit.

The foregoing and other objects, features, and advantages of the invention will be apparent from the following, more particular, description of the preferred embodiments of the invention, as illustrated in the accompanying drawing.

BRIEF DESCRIPTION OF THE DRAWINGS

The novel features believed characteristic of the invention are set forth in the appended claims. The invention itself, as well as a preferred mode of use, and advantages thereof, will best be understood by reference to the following detailed description of illustrated embodiments when read in conjunction with the accompanying drawings.

DETAILED DESCRIPTION OF THE PREFERRED EMBODIMENT

Figure 1:
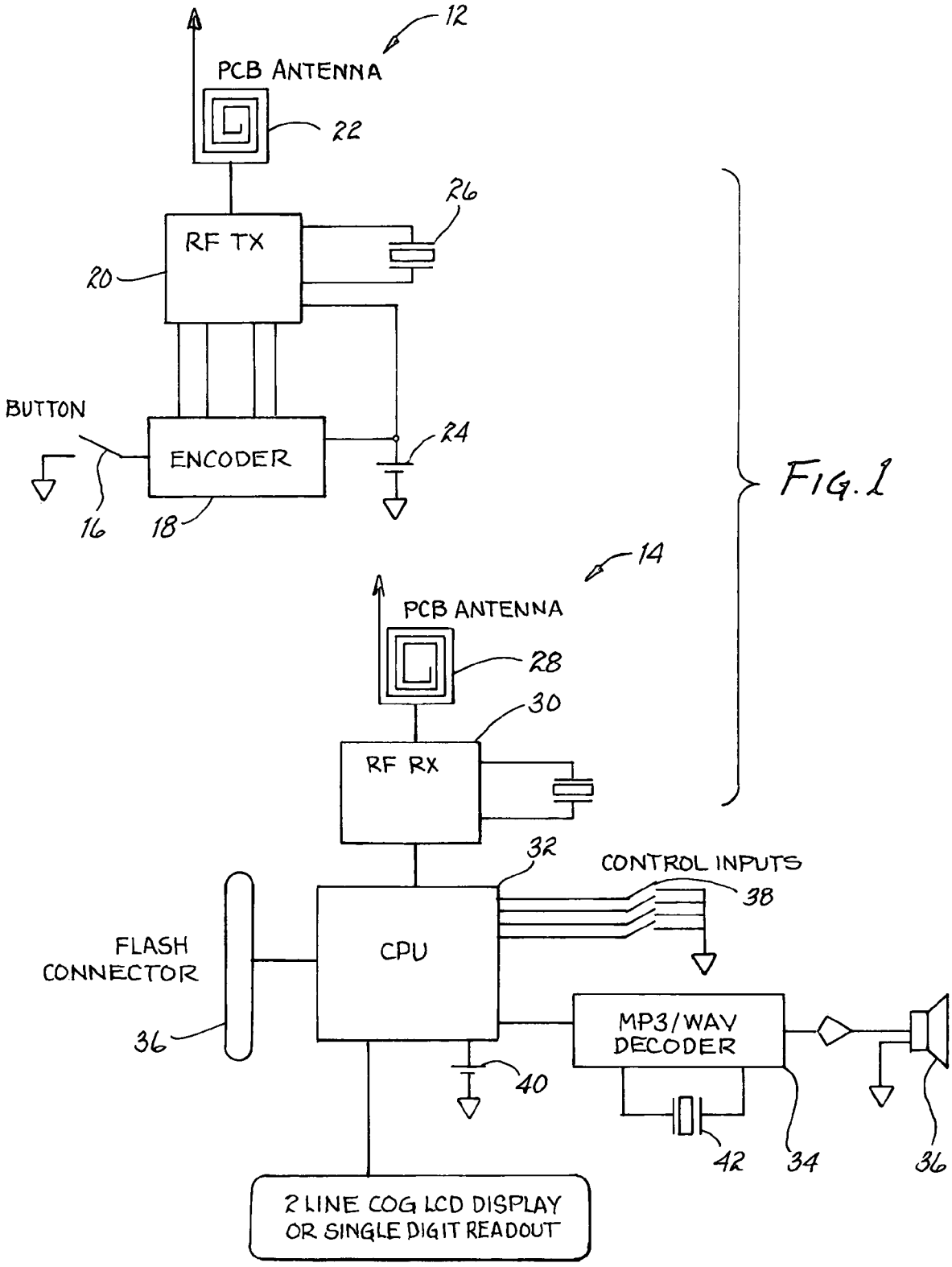
FIG. 1 is a simplified functional block diagram of the door chime system of the present invention.
Figure 2:
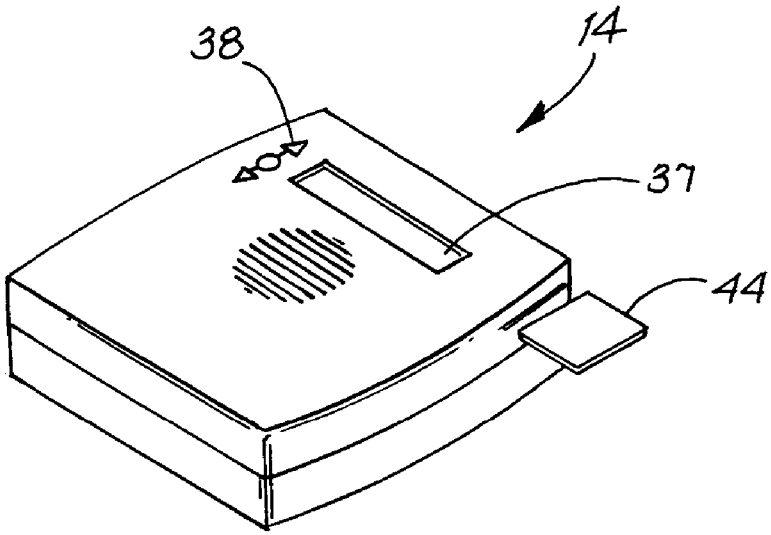
FIG. 2 is an elevated perspective view of the receiving unit of the door chime system of the present invention.
Figure 3:
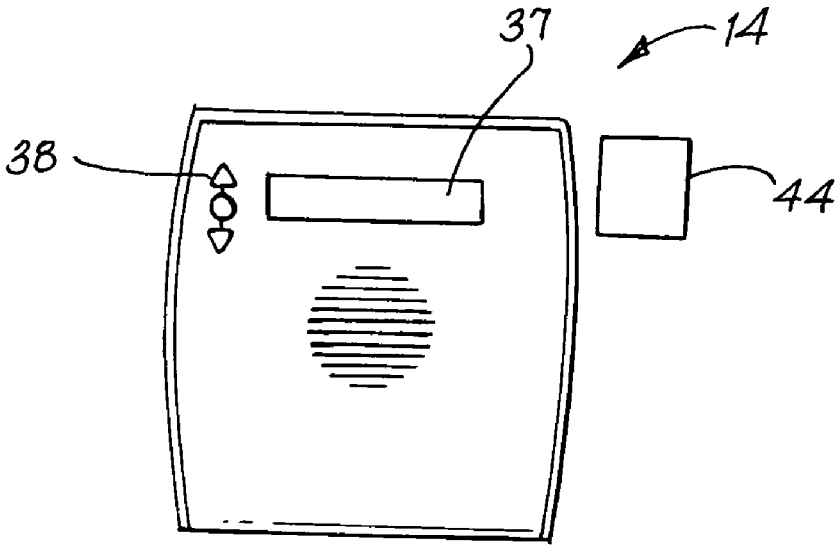
FIG. 3 is a front view of the receiving unit of the door chime system of the present invention.

Referring to the Figures, in FIG. 1, a simplified functional block diagram of the door chime system 10 of the present invention is shown. The door chime system 10 is comprised of two main components a door chime activation unit 12 and a receiving unit 14. The door chime system 10 is a wireless system. When activated, the door chime activation unit 12 will send an activation signal to the receiving unit 14. The receiving unit 14 upon receipt of the activation signal will play one of a plurality of high quality sounds to indicate that the someone has activated the activation unit 12. The receiving unit 14 has the ability to select which sound file to play and will display the current sound file selected. The receiving unit 14 allows a removable storage device 44 to easily change and load new high quality sound files to be played during activation of the door chime.

The activation unit 12 has an activation button 16. The activation button 16 is used to activate the door chime system 10. By depressing the activation button 16, one may signal that he/she is waiting by a door where the activation button 16 is installed. When pressed, the activation button 16 sends a signal to an encoder 18 which is coupled to the activation button 16. The encoder 18 takes the activation signal and converts the activation signal to a radio frequency (RF) activation signal for transmission. The RF activation signal is then sent to a transmitting device 20. The transmitting device then sends the RF activation signal via a transmitting antenna 22 to the receiving unit 14. A power supply 24 is coupled to the encoder 18 and the transmitting device 20 for powering the activation unit 12. An oscillator 26 may be coupled to the transmitting device 20. The oscillator 26 allows for adjustable phase shifts and frequency modulations.

The receiving unit 14 has a receiving antenna 28. The receiving antenna 28 retrieves the RF activation signal and sends the RF activation signal to a receiving unit 30. The receiving unit 30 processes the RF activation signal and sends the processed signal to a processor unit 32. Upon receipt of the processed signal, the processor unit 32 will send a high quality sound file to a decoding unit 34. The sound file may be an MP3 file, a WAV file, or the like. The listing of the above files should not be seen as to limit the scope of the present invention. The sound file can be one already stored in the processor unit 32. Alternatively, a memory reader 36 is coupled to the processor unit 32. The memory reader 36 will read data stored on a memory storage device 44 which is inserted into the memory reader 36. The memory reader 36 will then transfer this data to the processor unit 32. The decoding unit 34 will take and decode the sound file and send the decoded sound file to a speaker 36. The processor unit 32 may be programmed to send only a designated sound file to the decoding unit 34, to play the loaded sound files in a designated order, to randomly play a different sound file which is loaded, etc. The above are given as examples and should not be seen as to limit the scope of the present invention.

A display unit 37 is coupled to the processor unit 32. The display 37 may be any type of display such as an LCD or the like. The display unit 37 will show different information regarding the door chime system 10. For example, the display unit 37 may show what sound file is currently loaded, the display unit 37 may also show all the files either loaded in the memory of the processor unit 32 or on a memory storage device 44 in the memory reader 36, sound volume, etc. The listing of the above are given as examples and should not be seen as to limit the scope of the present invention.

One or more switching units 38 are coupled to the processor unit 32. The switching units 38 are used to allow a person to change the operating features of the door chime system 10. For example, the switching units 38 may be used to select different sound files to be played. The switching units 38 may be used to select different files either loaded in the memory of the processor unit 32 or on a memory storage device 44 in the memory reader 36. The switching units 38 may also be used to adjust the sound volume of the door chime system 10 or to adjust other sound quality features. The switching units 38 may even be used to adjust the brightness of the display unit 37. The above are given as examples and should not be seen as to limit the scope of the present invention. The switching units 38 may be used for other purposes without departing from the spirit and scope of the present invention.

A power supply 40 is coupled to the processor unit 32 to power the different elements in the receiving unit 14. An oscillator 42 may be coupled to the receiving unit 30 and to the decoding unit 34. The oscillator 42 allows for adjustable phase shifts and frequency modulations.

Operation

In operation, one inserts a memory storage device 44 into a memory reader 36. The memory storage device 44 may be a compact flash card, a secure digital memory card, a memory stick, or the like. The listing of the different memory devices should not be seen as to limit the scope of the present invention. The memory storage device 44 allows one to easily change and load different sound files into the receiving unit 14. One can review the different sound files loaded into the receiving unit 14 by using the switching units 38. The switching units 38 allow one to easily scroll through the different sound files (i.e., either loaded in the memory of the processor unit 32 or on the memory device 44 in the memory reader 36). The name of each sound file may be viewed in the display unit 37. After reviewing the different sound files, one may use the switching units 38 to select the sound file to be played. The desired sound file is then loaded into the processing unit 32 as the sound file to be played when the activation button 16 is used to activate the door chime system 10.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A wireless door chime system comprising:

an activation unit;

a receiving unit in wireless communication with the activation unit, the receiving unit having a plurality of sound files loaded therein wherein a user can view the plurality of sound files and select a sound file to play when the activation unit sends a signal to the receiving unit, wherein the receiving unit comprises:

a receiving antenna;

a receiving unit coupled to the receiving antenna;

a processing unit coupled to the receiving unit, wherein the processing unit stores at least one sound file;

a decoding unit coupled to the processing unit for decoding the sound file to be played;

a speaker coupled to the decoding unit; and a memory storage reader coupled to the processing unit, the memory storage reader transferring sound files stored on a memory storage device to the processing unit;

a plurality of control buttons located on the receiving unit to control operation of the receiving unit; and a display unit located on the receiving unit to show operating information of the wireless door chime system, wherein the display unit will show the sound files stored in the receiving unit, a user scrolling through the sound files using at least one control button and selecting one of the sound files using at least one control button.

2. A wireless door chime system in accordance with claim 1 wherein the display unit is an LCD.

3. A wireless door chime system in accordance with claim 1 wherein the switching units are used to adjust sound quality of the wireless door chime system.

4. A wireless door chime system in accordance with claim 1 wherein the switching units are used to adjust sound and brightness of the display unit.

5. A wireless door chime system in accordance with claim 1 wherein the receiving unit further comprises oscillating units coupled to the receiving unit and the decoding unit to allow for adjustable phase shifts and frequency modulations.

6. A wireless door chime system in accordance with claim 1 wherein the activation unit comprises:

a transmitting antenna;

a transmitter coupled to the transmitting antenna;

an encoder coupled to the transmitter; and an activation switch coupled to the encoder.

7. A wireless door chime system in accordance with claim 6 wherein the activation unit further comprises an oscillator coupled to the transmitter to allow for adjustable phase shifts and frequency modulations.

8. A wireless door chime system comprising:

an activation unit wherein the activation unit comprises:

a transmitting antenna;

a transmitter coupled to the transmitting antenna;

an encoder coupled to the transmitter; and an activation switch coupled to the encoder; and a receiving unit in wireless communication with the activation unit, the receiving unit having a plurality of sound files loaded therein wherein a user can view the plurality of sound files and select a sound file to play when the activation unit sends a signal to the receiving unit, the receiving unit comprising:

a receiving antenna;

a receiving unit coupled to the receiving antenna;

a processing unit coupled to the receiving unit, wherein the processing unit stores at least one sound file;

a decoding unit coupled to the processing unit for decoding a sound file to be played;

a speaker coupled to the decoding unit; and a memory storage reader coupled to the processing unit, the memory storage reader transferring sound files stored on a memory storage device to the processing unit;

a display unit coupled to the processing unit, the display unit showing different information regarding the door chime system;

switching units coupled to the processing unit for controlling operating features of the receiving unit;

wherein the display unit will show the sound files stored in the receiving unit, a user scrolling through the sound files using at least one switching unit and selecting one of the sound files to be played using at least one switching unit.

9. A wireless door chime system in accordance with claim 8 wherein the switching units are used to adjust sound quality of the wireless door chime system.

10. A wireless door chime system in accordance with claim 8 wherein the switching units are used to adjust sound and brightness of the display unit.

11. A wireless door chime system in accordance with claim 8 wherein the receiving unit further comprises oscillating units coupled to the receiving unit and the decoding unit to allow for adjustable phase shifts and frequency modulations.

* * * * *